US006590342B1

(12) United States Patent
Onnekes-Van Der Voort et al.

(10) Patent No.: US 6,590,342 B1
(45) Date of Patent: Jul. 8, 2003

(54) METAL HALIDE LAMP HAVING HALIDE RESISTANT CURRENT CONDUCTORS

(75) Inventors: Elisabeth Onnekes-Van Der Voort, Turnhout (BE); Hendrik Dreuning, Eindhoven (NL); Franciscus H. Van Lierop, Shanghai (CN); Peter A. Seinen, Eindhoven (NL); Martin F. C. Willemsen, Hong Mei Lu (CN); Mark Bolech, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/453,422

(22) Filed: Dec. 2, 1999

(30) Foreign Application Priority Data

Dec. 8, 1998 (EP) ..... 98204164

(51) Int. Cl.[7] ..... H01J 61/06

(52) U.S. Cl. ..... 313/633; 313/331; 313/326; 313/573

(58) Field of Search ..... 313/493, 622–626, 313/631, 634, 642, 331–332, 326, 620, 639, 640, 570, 573, 638, 318.12, 582, 509; 315/224, 240, 287; 428/426; 257/764

(56) References Cited

U.S. PATENT DOCUMENTS 3,668,391 A * 6/1972 Kimball ..... 313/318.12
3,959,683 A * 5/1976 Kupsky ..... 313/582
4,755,712 A * 7/1988 Mujahid et al. ..... 313/331
5,329,161 A * 7/1994 Vines et al. ..... 257/764
5,332,627 A * 7/1994 Watanabe et al. ..... 428/426
5,424,609 A 6/1995 Geven et al. ..... 313/623
5,923,127 A * 7/1999 Keijser et al. ..... 313/634 X
5,973,453 A * 10/1999 Van Vliet et al. ..... 313/623
6,111,357 A * 8/2000 Fleming et al. ..... 313/509

* cited by examiner

*Primary Examiner*—Vip Patel
*Assistant Examiner*—Joseph Williams
(74) *Attorney, Agent, or Firm*—Ernestine C. Bartlett

(57) ABSTRACT

The electric lamp has a ceramic lamp vessel (1) having a filling of rare gas and metal halide. Current conductors (2, 3) which support electrodes (4, 5) inside the discharge vessel (1) enter the discharge vessel (1) in a gastight manner through a ceramic sealing compound (6). At least one of the current conductors (2, 3) has inside the lamp vessel (1) a first, halogen-resistant part (21, 31) which is selected from tungsten silicide, molybdenum aluminide, molybdenum boride, pentamolybdenum trisilicide and combinations of at least two of these intermetallic compounds. These compounds have a coefficient of thermal expansion which corresponds to that of the discharge vessel (1). It is thereby prevented that the discharge vessel starts leaking if the ceramic sealing compound (6) extends beyond the first part (21, 31). As a result of their coefficient of thermal expansion, the intermetallic compounds may constitute the second part (22, 32) of the current conductors (2, 3) as well, which part (22, 32) is surrounded by the ceramic sealing compound (6) in a gastight manner.

16 Claims, 1 Drawing Sheet

METAL HALIDE LAMP HAVING HALIDE RESISTANT CURRENT CONDUCTORS

BACKGROUND OF THE INVENTION

The invention relates to an electric discharge lamp comprising:

a light-transmissive ceramic lamp vessel;

a first and a second current conductor entering the lamp vessel and each supporting an electrode in the lamp vessel;

a ceramic sealing compound sealing the lamp vessel around the current conductors in a gastight manner;

an ionizable filling comprising a rare gas and metal halide in the lamp vessel, at least the first current conductor within the lamp vessel having a first halide-resistant part and a second part extending from the ceramic sealing compound to the exterior of the lamp vessel.

Such an electric lamp is known from U.S. Pat. No. 5,424,609.

The current conductors of such a lamp must have a linear coefficient of thermal expansion which corresponds to that of the lamp vessel in order to prevent leakage of the lamp. Leakage may even occur in the manufacture of the lamp when the lamp cools down after the ceramic sealing compound has been provided at a relatively high temperature. At a too small coefficient of expansion of the current conductor, the lamp vessel shrinks to a stronger extent and it may crack or even break. At a too large coefficient of expansion, leakage may occur around the current conductors.

However, the current conductors must also be resistant to the ionizable filling of the lamp, particularly to halide, at least in so far as they are in contact therewith: they should at least not substantially be attacked by or react with halide or halogen formed therefrom. A low resistance may not only result in damage and destruction of the current conductor but also in a loss of halide in the filling and in a color change of the light generated by the lamp. Moreover, the current conductors must withstand the thermal manufacturing and operating conditions of the lamp and, to inhibit electrical losses, they should be good conductors.

Since the requirements imposed on expansion and chemical resistance are often not combined in one material, at least the first current conductor of the known lamp within the lamp vessel has a first halide-resistant part having a different expansion than the lamp vessel, and a second part which extends from the seal and is not halide-resistant but has a corresponding expansion. This part often consists of niobium, tantalum or an alloy thereof, metals which, due to their oxidation sensitivity at higher temperatures, should be screened from air by using an outer envelope for the lamp.

If the lamp vessel is relatively narrow and elongate, and if it has a vertical operating position, the halide and the halogen formed therefrom are particularly present in the lower portion of the lamp vessel. It is then sufficient when only the first current conductor has a first halide-resistant portion and is present in the lower part of the lamp vessel. However, the lamp can then not be operated upside down, horizontally or obliquely. However, for obtaining a universal operating position, the lamp can be given a second current conductor corresponding to the first.

The first part of the current conductors of the known lamp has at least at its surface tungsten, molybdenum or molybdenum disilicide. The first part may be alternatively a solid rod of the materials described.

It is a drawback of the known lamp that leakage does occur if the ceramic sealing compound extends as far as the first part and also connects this part to the lamp vessel. Nevertheless, it may be necessary to surround the second part of the current conductors within the lamp vessel entirely with the ceramic sealing compound so as to protect it from a halide attack. It has then proved to be difficult to provide the ceramic sealing compound in such an amount that the material at least substantially surrounds the second part but does not directly connect the first part to the lamp vessel.

SUMMARY OF THE INVENTION

It is an object of the invention to provide an electric lamp having a construction which is easy to manufacture and obviates the risk of leakage owing to ceramic sealing compound which also directly connects the first part of a current conductor to the lamp vessel.

According to the invention, the first part of the first current conductor consists essentially of an intermetallic compound material chosen from tungsten silicide, pentatungsten trisilicide, molybdenum aluminide, molybdenum boride, pentamolybdenum trisilicide and combinations of at least two of these materials.

In a preferred embodiment, the second current conductor 9150 has such a first and a second part. This embodiment simplifies the manufacture of the lamp because the same components are used for both current conductors. The lamp can then be operated in an arbitrary position, while halide attack and the risk of leakage are inhibited.

It was found that tungsten silicide in the form of $WSi_2$ and in the form of $W_5Si_3$, molybdenum aluminide, $Mo_3Al$, molybdenum boride, MoB, and pentamolybdenum trisilicide, $Mo_5Si_3$, have a linear coefficient of thermal expansion which corresponds to that of the lamp vessel. These intermetallic compounds are thermally and chemically stable in the circumstances of manufacturing and operating the lamp. This is in contrast to the molybdenum disilicide mentioned in U.S. Pat. No. 5,424,609, which decomposes when used as a material of the first part of the current conductor(s) upon welding to the electrode and to the second part of the current conductor(s). The materials, particularly $Mo_3Al$ and notably $WSi_2$ can easily be processed as well as $W_5Si_3$ and $Mo_5Si_3$.

The intermetallic compounds may be used in the lamp as sintered bodies or as wires or rods drawn from sintered bodies Although this is generally not necessary, a small volume, for example, several tenths of percents to several percents of metal having a relatively low linear coefficient of thermal expansion such as tungsten or molybdenum may be added to the intermetallic compound so as to give the expansion an even greater conformity with that of the lamp vessel.

Due to the favorable coefficient of expansion, the second part of a current conductor may consist of the same material as the first part and this current conductor may even be one integral body. This saves a welding operation.

It is not objectionable if the current conductors do not have a second part of hydrogen-transmissive material because the presence of water from which hydrogen is produced in the lamp can be substantially prevented by careful manufacture. Moreover, the ceramic lamp vessel itself is hydrogen-permeable at the relatively high operating temperatures and the lamp may be operated, for example initially, at a power supply which can obviate an increased ignition voltage owing to the presence of hydrogen.

An important advantage of current conductors with a second part extending beyond the lamp vessel and made of the same material as for the first portion is that the material is also resistant to oxygen at a higher temperature so that the lamp can be operated directly in air and does not need an outer envelope which is sealed in a gastight manner.

It is favorable if the electric lamp has a lamp vessel with narrow end parts in which a respective current conductor is enclosed, the end parts having a free end where the lamp vessel is sealed by the ceramic sealing compound. This embodiment has the advantage that the ceramic sealing compound is relatively far remote from the electrodes and thus has a relatively low temperature, while yet preventing that the lamp vessel behind the electrodes has a relatively large volume of low temperature where halide could condensate and could thus be withdrawn from the discharge. The volume of the end parts is small and is also sufficiently heated due to the passage of current through the current conductors so as to prevent accumulation of halide.

The ionizable filling may not only comprise a rare gas as an ignition gas such as, for example argon, but also one or more halides, for example iodides such as, for example, a mixture of iodides of Na, Tl and Dy, possibly with Ho and Tm, or a mixture of iodides of, for example, Na, Tl, Ca and Ho so as to radiate light at a color temperature of 3000 K., or a mixture of iodides of, for example, Na, Tl, Ca, Ce, Dy, Ho and Tm so as to generate light at a temperature of 4000 K.

The lamp vessel may consist of mono or polycrystalline material such as aluminium oxide or sapphire.

The ceramic sealing compound may be, for example, a mixture of aluminum oxide, silicon oxide or dysprosium oxide or magnesium oxide.

These and other aspects of the invention are apparent from and will be elucidated with reference to the embodiments described hereinafter.

DETAILED DESCRIPTION OF THE PREFERRED EMBODIMENTS

Figure 1:
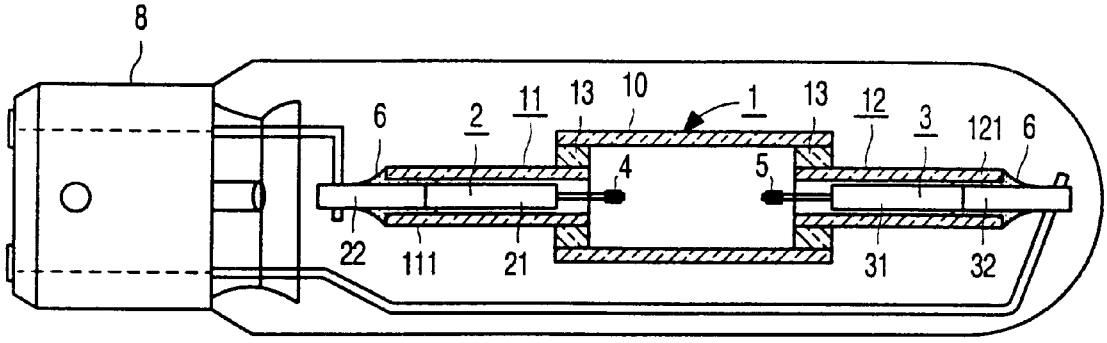
FIG. 1 shows a first embodiment in a side elevation, partly in a cross-section.

In FIG. 1, the electric discharge lamp has a tubular, light-transmissive ceramic lamp vessel 1, of polycrystalline aluminum oxide in the Figure, and a first and a second current conductor 2, 3 which enter the lamp vessel 1 opposite each other and each support an electrode 4, 5 in the lamp vessel 1, i.e. in the Figure a tungsten electrode which is welded to the current conductors 2, 3. A ceramic sealing compound 6, in the Figure 30% by weight of aluminum oxide, 40% by weight of silicon oxide and 30% by weight of dysprosium oxide, provided in a melting process seals the lamp vessel 1 around the current conductors 2, 3 in a gastight manner. The lamp vessel has an ionizable filling comprising argon as a rare gas and metal halide. A mixture of sodium, thallium and dysprosium iodide is used as a metal halide. At least the first current conductor 2 has a first halide-resistant part 21 within the lamp vessel 1 and, extending from the ceramic sealing compound 6 to the exterior of the lamp vessel, a second part 22 which is connected to the first part 21 by welding it to this part.

The first part 21 of the first current conductor 2 consists essentially of a material chosen from tungsten silicide, molybdenum aluminide, molybdenum boride, pentamolybdenum trisilicide and combinations of at least of two of these materials.

In the lamp shown, the second current conductor 3 has a similar first part 31 and second part 32 as the first current conductor 2. The second part 22, 32 of each of the two current conductors 2, 3 consists of niobium, the first part 21, 31 of each of the two consists of tungsten silicide, for example, $W_5Si_3$.

The lamp vessel 1 has narrow end parts 11, 12 in which a respective current conductor 2, 3 is enclosed. The end parts 11, 12 have a free end 111, 121, where the lamp vessel 1 is sealed by the ceramic sealing compound 6. The central part 10 of the lamp vessel 1 is connected by way of sintering to the end parts 11, 12 via ceramic discs 13.

The second part 22, 32 of the current conductors is entirely incorporated in the ceramic sealing compound 6 within the lamp vessel 1.

In FIG. 1, the lamp vessel 1 is enveloped by an outer envelope 7 which is sealed in a gastight manner and is evacuated or filled with an inert gas in order to protect the niobium second parts 22, 32 of the current conductors 2, 3. The outer envelope 7 supports a lamp cap 8. In another embodiment, the outer envelope 7 may be provided with two lamp caps, for example, R7 lamp caps.

Figure 2:
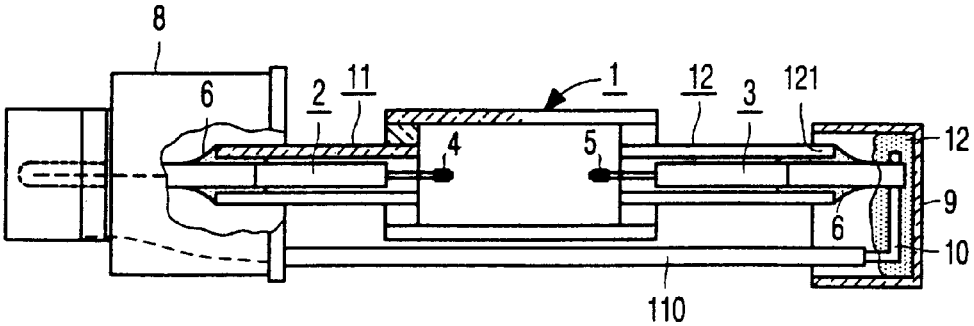
FIG. 2 shows a second embodiment in a side elevation, partly in a cross-section and partly broken away.

In FIG. 2, components corresponding to those of FIG. 1 have the same reference numerals. The second part of the current conductors 2, 3 in the lamp shown in this Figure also consists essentially of a material chosen from tungsten silicide, molybdenum aluminide, molybdenum boride, pentamolybdenum trisilicide and combinations of at least two of these materials and, likewise as the first part, consists in this Figure mainly of molybdenum aluminide. The current conductors 2, 3 thus each constitute one integral body.

The lamp vessel 1 is secured to a lamp cap 8. Around the current conductor 3, which exits at the end of the lamp vessel remote from the lamp cap 8, the lamp has a ceramic cap 9 which is fixed with cement 12. A conductor 10 incorporated in a ceramic tube 110 is connected to the current conductor 3. The lamp can safely be touched due to the tube 110 and the cap 9. The lamp can be operated in air due to the oxygen resistance of the current conductors 2, 3.

Trial lamps as described and shown in FIG. 1 were manufactured in various series, every time with two equal current conductors. The lamps were operated and their lamp voltage, color point and efficiency were compared with similar reference lamps of equal filling and equal power, but with a ceramic material as a halide-resistant first part of each of the two current conductors.

A first series of 2 lamps of 150 W had a tungsten disilicide first part of the current conductors. After 3000 hours of operation, the lamps still had the same properties as the reference lamps.

A second series of 2 lamps of 150 W had a molybdenum aluminide first part of the current conductors. After 3000 hours of operation, the lamps still had the same properties as the reference lamps.

A third series of 4 lamps of 400 W had a molybdenum boride first part of the current conductors. A tungsten electrode and a niobium wire had been fixed by sintering in a cavity in the end faces of the first portions. After 1000 hours of operation, the lamps still had the same properties as the reference lamps.

The satisfactory electrical conductivity and the halide-resistance of the intermetallic compounds used are apparent from the equal behavior of the trial lamps and the reference lamps. The thermal expansion of the compounds did not give rise to leakage, neither in the manufacture of the lamps nor during operation.

What is claimed is:

1. An electric discharge lamp comprising:

a light-transmissive ceramic lamp vessel;

a first and a second current conductor entering the lamp vessel and each supporting an electrode in the lamp vessel;

a ceramic sealing compound sealing the lamp vessel around the current conductors in a gastight manner;

an ionizable filling comprising a rare gas and metal halide in the lamp vessel, at least the first current conductor having a first halide-resistant part within the lamp vessel and a second part extending from the ceramic sealing compound to the exterior of the lamp vessel, wherein the first part consists essentially of an intermetallic compound material chosen from molybdenum aluminide, molybdenum boride, pentamolybdenum trisilicide and combinations of at least two of these materials; and said ceramic sealing compound circumferentially contacts and seals at least a portion of the first part of the first current conductor adjacent the second part.

2. An electric discharge lamp as claimed in claim 1 wherein the second current conductor has a first halide-resistant part within the lamp vessel and a second part extending from the ceramic sealing compound to the exterior of the lamp vessel, wherein the first part of the second current conductor consists essentially of an intermetallic compound material chosen from molybdenum aluminide, molybdenum boride, pentamolybdenum trisilicide and combinations of at least two of these materials; and said ceramic sealing compound circumferentially contacts and seals at least a portion of the first part of the second current conductor adjacent the second part.

3. An electric discharge lamp as claimed in claim 1 wherein the lamp vessel has narrow end portions in which respective said current conductors are enclosed, which end portions each have a free end where the lamp vessel is sealed by the ceramic sealing compound.

4. An electric discharge lamp as claimed in claim 1 wherein the second part is entirely enclosed in the ceramic sealing compound.

5. An electric discharge lamp as claimed in claim 1 wherein at least one of the current conductors is one integral body.

6. An electric discharge lamp as claimed in claim 1 wherein the material comprises molybdenum aluminide.

7. An electric discharge lamp as claimed in claim 1 wherein the material comprises pentamolybdenum trisilicide.

8. An electric discharge lamp, comprising:

a light-transmissive ceramic lamp vessel;

a first and a second current conductor each extending from outside the lamp vessel into the lamp vessel and terminating at a distal end within the lamp vessel, at least one of said current conductors consisting essentially of an intermetallic compound materials selected from the group consisting of tungsten silicide, pentatungsten trisilicide, molybdenum aluminide, molybdenum boride, pentamolybdenum trisilicide and combinations of at least two of these materials;

a first and a second discharge electrode, each at a respective said distal end of the first and second current conductors;

a ceramic sealing compound extending around the first and second current conductors and sealing the ceramic lamp vessel in a gas-tight manner; and an ionizable filling in the lamp vessel comprising a rare gas and a metal halide in the lamp vessel.

9. An electric discharge lamp as claimed in claim 8 wherein the material comprises tungsten silicide.

10. An electric discharge lamp as claimed in claim 9 wherein the tungsten silicide is a pentatungsten trisilicide ($W_5Si_3$).

11. An electric lamp according to claim 8, wherein the other of said current conductors consists essentially of an intermetallic compound material selected from the group consisting of tungsten silicide, pentatungsten trisilicide, molybdenum aluminide, molybdenum boride, pentamolybdenum trisilicide and combinations of at least two of these materials.

12. An electric discharge lamp according to claim 11, wherein said lamp vessel is not disposed within an outer lamp envelope sealed in gas tight manner, and said current conductors outside of said ceramic lamp vessel being exposed to air.

13. An electric discharge lamp according to claim 8, wherein said at least one current conductor comprises first and second parts welded together.

14. An electric discharge lamp according to claim 8, wherein said at least one current conductor consists of an integral body, without parts welded together.

15. An electric discharge lamp according to claim 8, wherein said integral body is one of (i) a sintered body of said material and (ii) a rod or wire drawn from a sintered body of said material.

16. An electric discharge lamp comprising:

a light-transmissive ceramic lamp vessel;

a first and a second current conductor entering the lamp vessel and each supporting an electrode in the lamp vessel;

a ceramic sealing compound sealing the lamp vessel around the current conductors in a gastight manner;

an ionizable filling comprising a rare gas and metal halide in the lamp vessel, at least the first current conductor having a first halide-resistant part within the lamp vessel and a second part extending from the ceramic sealing compound to the exterior of the lamp vessel, wherein the first and second parts each consist essentially of an intermetallic compound material chosen from tungsten silicide, pentatungsten trisilicide, molybdenum aluminide, molybdenum boride, pentamolybdenum trisilicide and combinations of at least two of these materials; and said ceramic sealing compound circumferentially contacts and seals at least a portion of the first part of the first current conductor adjacent the second part.

* * * * *